United States Patent [19]

Ohlsen

[11] Patent Number: 4,972,065

[45] Date of Patent: Nov. 20, 1990

[54] PORTABLE ELECTRIC HAIR DRYER WITH DETACHABLE NOZZLE

[75] Inventor: Heinz-Jürgen Ohlsen, Wuppertal, Fed. Rep. of Germany

[73] Assignee: Robert Krups Stiftung & Co. KG., Solingen, Fed. Rep. of Germany

[21] Appl. No.: 392,658

[22] Filed: Aug. 11, 1989

[30] Foreign Application Priority Data

Feb. 17, 1989 [DE] Fed. Rep. of Germany ..... 3904860

[51] Int. Cl.[5] ..... F24H 3/04; A45D 20/10

[52] U.S. Cl. ..... 392/380; 34/97; 392/385

[58] Field of Search ..... 219/373, 370, 364, 366, 219/369; 34/96, 97, 100, 98, 99

[56] References Cited

U.S. PATENT DOCUMENTS

| | | | |
|---|---|---|---|
| 4,366,368 | 12/1982 | Stephens, III | 219/373 |
| 4,430,808 | 2/1984 | Toyomi et al. | 219/373 |
| 4,538,362 | 9/1985 | Andis | 34/97 |
| 4,711,988 | 12/1987 | Thaler et al. | 219/370 |
| 4,848,007 | 7/1989 | Montagnino | 34/97 |

*Primary Examiner*—Philip H. Leung
*Assistant Examiner*—Geoffrey S. Evans
*Attorney, Agent, or Firm*—Peter K. Kontler

[57] ABSTRACT

A portable electric hair dryer wherein the hot-air outlet of the housing is connectable with a nozzle having a smaller outlet for directing a concentrated stream of hot air against the hair for drying and/or styling. The maximum achievable output of the heating element in the housing is automatically reduced in response to attachment of the nozzle to the housing to a value such that the temperature of concentrated stream of hot air issuing from the nozzle cannot reach a value which would cause singing or burning of hair. In accordance with a presently preferred embodiment, attachment of the nozzle to the housing results in shifting of a rod-shaped mechanical adjusting member which thereby deactivates one or more stages of a multi-stage switch so that the latter can permit selection of one or more heating element outputs which do not result in overheating of air issuing from the nozzle. The adjusting member is biased toward its inoperative position which it assumes in response to detachment of the nozzle from the housing.

24 Claims, 2 Drawing Sheets

PORTABLE ELECTRIC HAIR DRYER WITH DETACHABLE NOZZLE

BACKGROUND OF THE INVENTION

The invention relates to improvements in electric hair drying and hair styling apparatus (hereinafter called hair dryers), and more particularly to improvements in hair dryers of the type wherein an air flow concentrating nozzle is connectable to and detachable from the air discharging outlet of the housing.

A portable hair dryer normally comprises a hollow housing with an inlet and an outlet, a motor-driven impeller which serves as a means for inducing the flow of air from the inlet to the outlet when the hair dryer is in use, and normally adjustable means for heating the air stream between the inlet and the outlet. This ensures that the temperature of the air stream issuing from the housing by way of the outlet suffices for desired drying or styling of the hair of a person using the hair dryer or of a customer in a beauty salon. It is also known to furnish a portable hair dryer with a detachable air flow concentrating nozzle which can be connected to or detached from the housing and, when in use, serves to reduce the cross-sectional area of the stream of heated air which issues from the hair dryer. The controls for the electric motor which drives the impeller and the means for selecting the output of the heating element or elements of the heating means are or can be installed in and on a hollow handle which is normally provided to facilitate manipulation of the hair dryer and usually extends at an obtuse angle to the direction of air flow from the inlet to the outlet of the main portion of the housing.

The output of a modern hair dryer is rather high, often well in excess of 1000 watts, and the trend is toward still higher outputs. Such hair dryers operate quite satisfactorily, as long as heated air is permitted to escape through the relatively large outlet of the housing. However, the temperature of outflowing heated air is likely to reach unacceptably high values if the selected output is 1000 watts or more and the user cf the hair dryer decides to install the nozzle in front of the outlet of the housing. Under such circumstances, the temperature of outflowing heated air can reach and even considerably exceed a value (normally between 120° and 130° C.) at which hot air is likely to singe or actually burn the hair.

Attempts to overcome the drawbacks of the aforediscussed hair dryers include the provision of a temperature monitoring device which is installed in or close to the outlet of the housing and serves to generate signals which are used to reduce the output of the heating element or elements when the monitored temperature is too high so that hot air issuing by way of the nozzle would be likely to damage or burn the hair and/or cause injury to the person. It is also known to adjust the maximum output which can be achieved when the monitoring device transmits a signal. Such monitoring devices are effective and useful; however, the utilization of monitoring devices necessitates the installation of numerous electronic components or modules which contribute significantly to the initial and maintenance cost of the hair dryer. Moreover, the circuits embodying temperature monitoring devices are prone to malfunction.

OBJECTS OF THE INVENTION

An object of the invention is to provide a novel and improved hair dryer which is constructed and assembled in such a way that it cannot damage the hair even if it is used with an air flow concentrating nozzle and even if the maximum output of its air heating means is in the range of or well in excess of 1000 watts.

Another object of the invention is to provide a novel and improved nozzle for use in the above outlined hair dryer.

A further object of the invention is to provide the hair dryer with novel and improved means for selecting the output of the heating element or elements.

An additional object of the invention is to provide a hair dryer with a maximum output in the range of 1500 watts or more which can be used with a nozzle without risking damage to the hair and/or injury to the head of the user or to the head of a customer in a beauty salon or another establishment employing portable electric hair dryers with detachable air flow concentrating nozzles.

Still another object of the invention is to provide a hair dryer wherein the cross-sectional area of the air discharging outlet of the nozzle can be a small or extremely small fraction of the cross-sectional area for air which issues from the hair dryer when the nozzle is detached from the housing.

A further object of the invention is to provide a hair dryer which can be used by its owner for the drying or styling of her or his own hair as well as by professional hair stylists in barber shops, beauty salons and similar establishments.

An additional object of the invention is to provide a hair dryer which cannot damage the hair, either with or without a nozzle, and wherein such safe operation can be achieved without resorting to complex, costly and sensitive electronic circuits.

A further object of the invention is to provide a hair dryer which exhibits the above outlined features but is neither bulkier nor more complex nor more expensive than a conventional hair dryer with the same output.

Another object of the invention is to provide a novel and improved method of preventing damage to hair when using high-output portable hair dryers with detachable air flow concentrating nozzles.

An additional object of the invention is to provide a novel and improved housing for the above outlined hair dryer.

SUMMARY OF THE INVENTION

The invention is embodied in a hair dryer, particularly in a portable hair dryer, which comprises a housing having an air admitting inlet and an air discharging outlet which is spaced apart from the inlet. The housing defines a path for the flow of air from the inlet to the outlet, and the hair dryer further comprises means (such as a motor-driven impeller) for inducing the flow of air from the inlet to the outlet, adjustable means for heating the stream of air in the path, a flow-directing nozzle which is separably connected to the outlet of the housing, and means for adjusting the heating means in response to connection or attachment of the nozzle to the outlet. The heating means includes a heating element (e.g., a resistance heater) having a predetermined range of different outputs and means for selecting a desired output of the heating element within the predetermined range. The adjusting means preferably includes means for preventing selection of at least one of the different outputs within the aforementioned range. The range of outputs includes a maximum output and at least one additional output, and the adjusting means preferably includes means for preventing selection of the maximum output while the nozzle remains connected to the outlet of the housing.

In accordance with a presently preferred embodiment of the improved hair dryer, the adjusting means includes at least one adjusting member which is movably carried by the housing and is movable relative to the housing between at least one first position and a second position. The nozzle of such hair dryer is provided with means for maintaining the adjusting member in the second position as long as the nozzle remains connected to the outlet of the housing. The adjusting means can further comprise means for biasing the adjusting member to the at least one first position, and the maintaining means preferably comprises means for moving the adjusting member from the at least one first position to the second position in response to connection of the nozzle to the outlet of the housing.

The selecting means can include a first and a second electric contact, and the adjusting member can include means for moving one of the contacts in response to connection of the nozzle to the outlet of the housing. The adjusting member can be mounted for reciprocatory movement between the at least one first position and the second position; for example, the housing can be provided with internal guide means for the adjusting member, and such guide means can include a dovetailed or otherwise configurated groove for a median portion of the adjusting member. Such adjusting member can further comprise a second portion which is or can be inclined with reference to the median portion, and the one electric contact can be provided on the second portion of the adjusting member. The other contact can be mounted in the housing adjacent the one contact. The biasing means is designed to bias the second portion of and hence the entire adjusting member to the at least one first position in which the one contact is disposed at a first distance from (e.g., in actual engagement with) the other contact. The one contact is disposed at a different second distance from the other contact in response to movement of the adjusting member to its second position (for example, the two contacts are then spaced apart from each other so that the switch including such contacts is open).

The selecting means can further comprise a casing for the second portion of the adjusting member, for the two contacts and for the biasing means. In addition, the selector means can include a circuit board which is preferably installed in a hollow handle of the housing, and the other contact can be provided on the circuit board. The casing, too, can be mounted on the circuit board and is preferably confined in the handle. The casing can resemble a cup having a bottom wall which is remote from the second portion of the adjusting member. Such bottom wall and the second portion of the adjusting member can be provided with confronting studs or retainers which are spaced apart from each other and extend into the respective end convolutions of a coil spring which constitutes or forms part of the aforementioned biasing means and serves to bias the second portion and hence the entire adjusting member to the at least one first position (in which the aforementioned switch is open to prevent selection of the maximum output of the heating element). The circuit board can be provided with an opening through which the second portion of the adjusting member extends into the casing, and the circuit board can further comprise one or more apertures for one or more male detent elements (e.g., in the form of resilient claws) which serve to couple the casing to the circuit board in the interior of the hollow handle.

The means for biasing the adjusting member to the at least one first position can comprise a plurality of resilient elements such as the aforementioned coil spring and a second coil spring which latter reacts against the housing (e.g., against a wall of the hollow handle) and bears against a third portion of the adjusting member between the median portion and the second portion. A stud of the third portion of the adjusting member can extend into the adjacent end convolution or convolutions of the second coil spring.

The housing can be provided with means for limiting the extent of movability of the adjusting member with reference to the housing. Such limiting means can be provided in a front section of the housing. The front section can further include the outlet, and a rear section of the housing preferably defines the inlet for atmospheric air.

The cross-sectional area of the outlet which forms part of the housing is or can be much larger than the cross-sectional area of the air discharging outlet of the nozzle. For example, the cross-sectional area of the outlet of the housing can be several times the cross-sectional area of the outlet of the nozzle.

The novel features which are considered as characteristic of the invention are set forth in particular in the appended claims. The improved hair dryer itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figures 1, 2, 3:
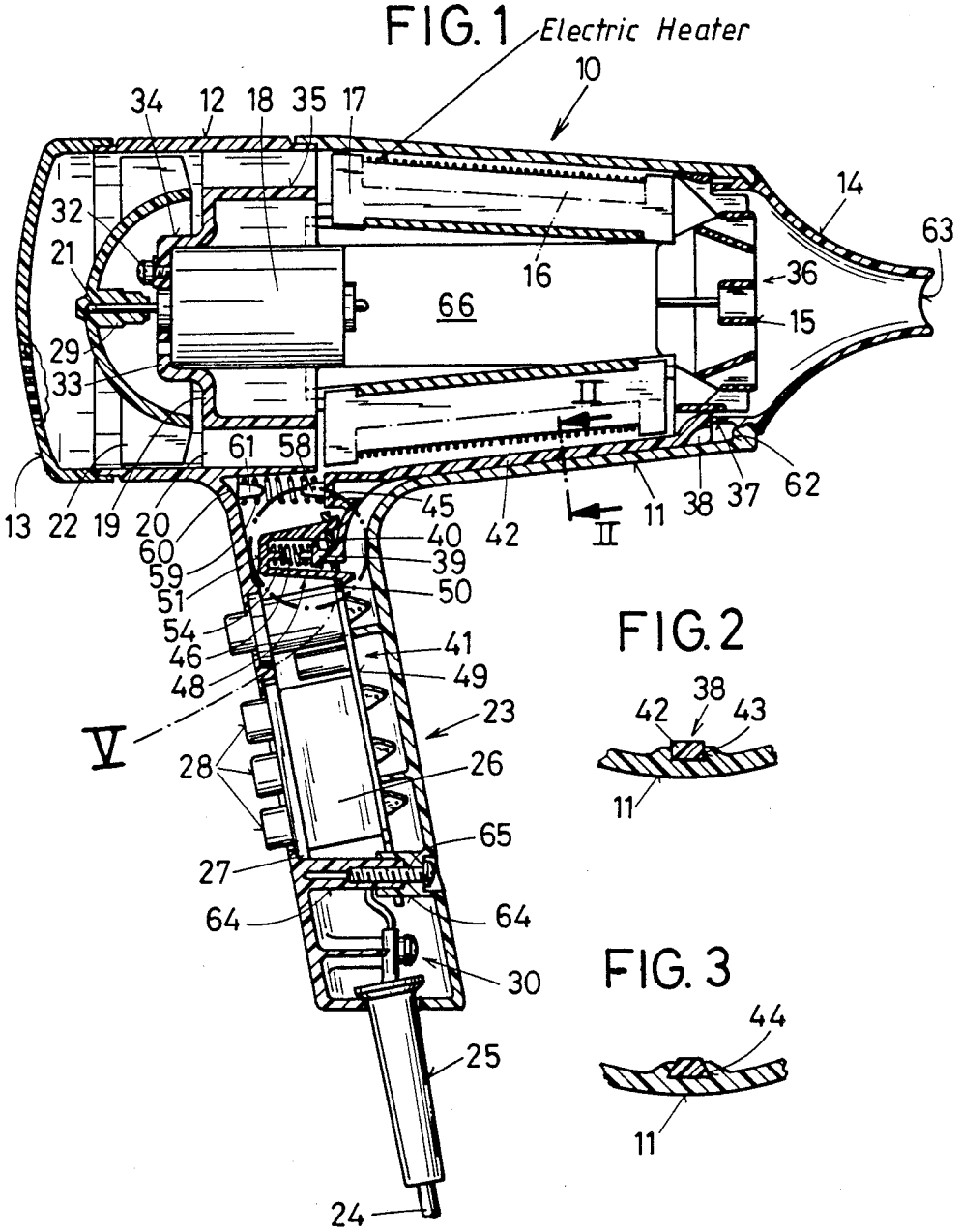
FIG. 1 is a central vertical sectional view of a portable hair dryer which embodies one form of the invention with the nozzle connected to the outlet of the housing.
FIG. 2 is an enlarged fragmentary transverse sectional view as seen in the direction of arrows from the line I of FIG. 1.
FIG. 3 is a similar fragmentary transverse sectional view of portion of a slightly modified hair dryer.

The drawing shows only those parts of the improved hair dryer 10 which are necessary for a complete understanding of the invention. For example, the drawing does not show all details of the electric circuitry and/or all details of the heating element and/or all details of the controls. The circuitry includes a first circuit board 66 in the main part of the housing of the improved hair dryer, and a second circuit board 49 in a hollow handle 23. With the sole exception of two contacts 40, 50 of a single switch, the various conductors and other parts of the electrical and electronic components are not shown in the drawing because they form no part of the present invention. The circuit board 66 is surrounded by the electric heating element 16 of the hair dryer 10 and is installed downstream of an electric motor 18 which drives a rotary air flow inducing impeller 22.

The non-illustrated parts of the improved hair dryer 10 are or can be identical with those of commercially available hair dryers, for example, the portable "Turbo Pocket" 1000 watt dual voltage (110/220 volts) international travel hair dryer No. 415 which is produced and distributed by the assignee of the present application.

The illustrated hair dryer 10 comprises a housing which includes a front section 11 with an outlet 36 for heated air, a rear section 12 having an inlet for admission of cool atmospheric air, and the piston grip type handle 23 which is forwardly inclined with reference to the direction of air flow from the inlet to the outlet 36. The sections 11, 12 and the hollow handle 23 of the housing can be made from an insulating material, especially an insulating plastic material. The handle 23 can include a front part which is integral with the section 11 and a rear part which is integral with the section 12. The means or releasably securing the sections 11, 12 and the two parts of the handle 23 to each other can comprise male and complementary female detent elements of conventional design, not shown. It is also possible to more or less permanently connect the sections 11, 12 and the parts of the handle 23 to each other.

Figure 4:
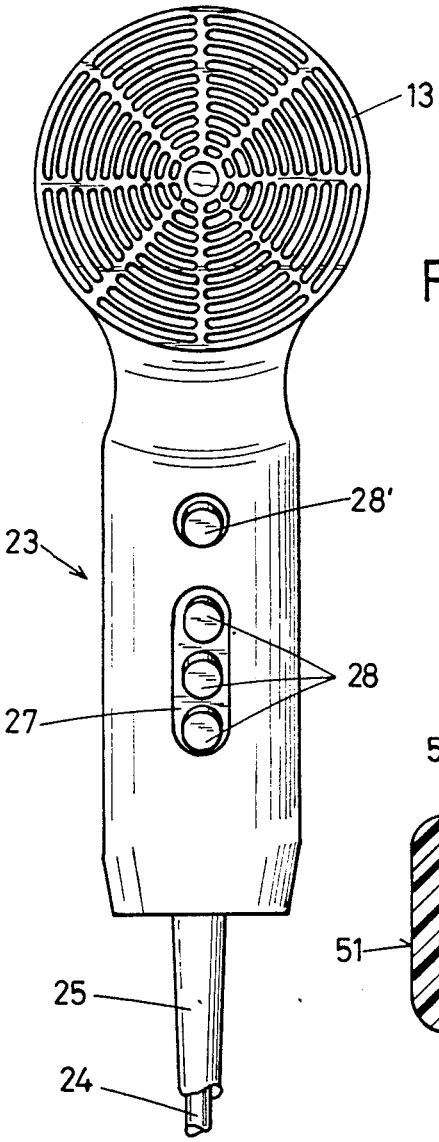
FIG. 4 is a rear elevational view of the hair dryer as seen from the left-hand side of FIG. 1.

The inlet in the rear section 12 of the housing contains a filter or screen 13 which can be designed in a manner as shown in FIG. 4, i.e., with arcuate slots which together form several concentric circles. The filter 13 is detachably secured to the rear end of the housing section 12 by means of elastic prongs extending into complementary recesses of the filter or section 12. The slots, which alternate with arcuate and radially extending ribs of the filter 13, admit atmospheric air into the range of the aforementioned rotary impeller 22 which is mounted on the output element 21 of the electric motor 18 in the housing sections 11 and 12.

The outlet 36 of the front housing section 11 contains a grate or grid 15 which is a one-piece body of plastic material and includes several concentric rings and radially extending connecting ribs or webs between neighboring rings. At least one of the rings constitute a hollow conical frustum. The conicity of such frustum is preferably in the range of approximately 25°.

The front part of the radially outermost ring of the grate 15 is formed with a recess for the rearwardly extending annular portion 37 of an air flow concentrating and directing nozzle 14 which is detachably connected to the housing section 11 in front of the outlet 36. The means for separably coupling the nozzle 14 to the housing section 11 preferably includes complementary male and female detent elements. For example, the male detent elements can constitute elastic pawls with pallets which can snap into complementary notches. The pawls can be provided on the rear portion 37 of the nozzle or on the foremost portion of the housing section 11. The notches and pawls can be formed at the time of making the section 11 and the nozzle 14. All that counts is to ensure that the nozzle 14 can be reliably but separably connected to the housing section 11 so that it receives heated air from the outlet 36. The cross-sectional area of the outlet 63 of the nozzle 14 is or can be a minute fraction of the cross-sectional area of the outlet 36. In the embodiment which is shown in FIG. 1, the cross sectional area of the outlet 36 is many times the cross-sectional area of the outlet 63. This ensures desirable concentration of hot air which issues from the section 11 on its way toward and through the outlet 63 and into contact with the hair of a person requiring hair drying and/or styling.

The grate 15 is preferably removably installed in the housing section 11 in immediate or close proximity to the outlet 36. The rear portion of this grate serves to support the front end portion of a carrier 17 with substantially radially disposed panels for the heating element 16 of adjustable heating means in the section 11. The front end portion of the carrier 17 can extend into complementary notches in the rear portion of the grate 15 in a manner which is not shown in full detail but is described and shown in numerous United States and foreign patents and patent applications of the assignee of the present application. The heating element 16 can constitute an electric resistance heater or any other suitable heater, e.g., a heater employing thick film conductors. This heating element is installed in the housing section 11 ahead of a stationary guide ring 20 (also called diffuser) which surrounds the casing of the electric motor 18.

The diffuser 20 comprises a transversely extending substantially flat rear end wall 33 which is secured to the casing of the motor 18 by one or more threaded fasteners 32. The end wall 33 is integral with a forwardly extending cylindrical portion 34 which, in turn, is integral with a radially outwardly extending washer-like portion 19. The latter is integral with a second cylindrical portion 35 which is surrounded by the vanes of the diffuser 20. The output element 21 of the motor 18 extends rearwardly through the end wall 33 and is non-rotatably installed in the hub 29 of the impeller 22.

The vanes of the diffuser 20 are staggered with reference to the radially disposed panels of the carrier 17 as seen in the circumferential direction of the cylindrical portion 35 and housing sections 11, 12. Such distribution of vanes and panels ensures that inflowing air is thoroughly agitated in the region of the heating element 16 to thus reduce the temperature of the housing section 11. This, in turn, ensures that the housing section 11 is not overheated even if it is made of a plastic material which is not capable of standing elevated or very high temperatures.

The cylindrical portion 34 of the diffuser 20 constitutes a socket for the housing of the motor 18 so that the latter is properly centeried within the cylindrical portion 35 and within the annulus of vanes at the exterior of the cylindrical portion 35. When the motor 18 is on, the impeller 22 on the output element 21 causes a stream of air to flow from the inlet (i.e., through the slots of the filter 13), between the vanes of the diffuser 20, along the heating element 16, and into the outlet 36 of the housing section 11 to directly impinge upon hair or to pass through the nozzle 14.

The assembled handle 23 of the housing can have a substantially circular cross-sectional outline and is preferably designed to accommodate a substantial number of electrical, electronic and/or other parts of the hair dryer. The handle 23 extends downwardly and forwardly at an angle of less than 90° with reference to the axis of the front housing section 11. The means for internally reinforcing the handle 23 preferably comprises registering hollow sleeves 64 which are provided on the front and rear parts of the handle and receive threaded fasteners 65 which hold the two parts of the handle together and also prevent the front end of the section 12 from moving away from the rear end of the section 11. The sleeves 64 are or can be tapped to receive threaded fasteners 65.

The means 41 for selecting a desired output of the heating element 16 includes an electric switch 26 which is installed in the rear part of the handle 23 behind the aforementioned circuit board 49 and can be of a type which is available on the market. This switch is installed in front of a shield 27 in the rear part of the handle 23. The shield 27 is disposed in a window of the handle 23 (see particularly FIG. 4) and is a multistage switch which can select any one of several different outputs of the heating element 16 including a maximum output and at least one second output. As mentioned above, the maximum output of the heating element 16 can be in the region of or can exceed 1500 watts. The illustrated switch 26 is designed to select three different outputs for the heating element 16 and, therefore, this switch is provided with a group or set of three discrete actuating elements 28 in the form of depressible or otherwise movable buttons.

The selecting means 41 of the illustrated hair dryer 10 further comprises a second switch with an additional actuating element 28' which is depressed if the heating element 16 is to be turned off while the motor 18 continues to drive the impeller 22 so that the outlet 36 of the housing section 11 or the outlet 63 of the nozzle 14 discharges a stream of cool (unheated) air. The illustrated actuating element 28' is accessible to a finger of the hand holding the handle 23 at a level above the set of three actuating elements 28.

The selecting means 41 includes the circuit board 49 which supports the switch 26 and the switch including the actuating element 28'. The circuit board 49 preferably carries one or more additional components, for example, one or more electrical and/or electronic components including a voltage selector (not identified in FIG. 1).

One end of a cable or cord 24 of the hair dryer 10 carries a plug (not shown) which can be inserted into an outlet or another source of electrical energy. The other end of the cable 24 extends into the lower end portion of the handle 23 through an elongated relatively stuff tubular member 25 which prevents the cable from flexing in the region of the bottom end wall of the handle 23. The upper end portion of the tubular member 25 has a radially outwardly extending flange which prevents its extraction from the handle 23. A clamp 30 in the lower portion of the handle 23 engages the cable 24 at a level above the tubular member 25 to reduce the tensional stress upon the bare terminals of conductors which are connected to the circuit board 49 in the region of the illustrated sleeves 64 and fastener 65. The clamp 30 comprises two complementary portions in the form of shells which are held together by screws or by other fasteners to frictionally engage the cable 24 in the interior of the handle 23 and to thus prevent separation of bare terminals of the conductors from the circuit board 49, even in response to the exertion of a pronounced pull upon the accessible portion of the cable. The shells of the clamp 30 are rigid with the rear part of the handle 23.

The circuit board 49 is a relatively narrow flat elongated insulating panel, the same as the circuit board 66 for the motor 18. The circuit board 66 extends in the axial direction of the housing sections 11, 12 within the confines of the heating element 16 and carries various electrical and/or electronic components of the motor circuit. In order to simplify the assembly of the improved hair dryer 10, the circuit board 66 is preferably designed in such a way that the electrical and/or electronic components which are mounted thereon are properly connected with complementary components on the motor 18 in response to proper insertion of the circuit board 66 into the housing section 11. To this end, the circuit board 66 and at least one of the adjacent parts (such as the grate 15, the carrier 17 and/or the housing of the motor 18) can be provided with complementary mechanical coupling means which can establish a reliable form-locking connection between the circuit board 66 and such part or parts. Reference may be had to commonly owned copending patent applications Ser. Nos. 301,541 and 315,457 filed Jan. 24 and Feb. 23, 1989, respectively. The complementary mechanical coupling elements can carry, or they can be otherwise combined with, the complementary electrical and/or electronic coupling elements.

The carrier 17 of the electric heating element 16 can comprise two insulating panels which together form a cruciform support for the heating element. The two panels of the carrier 17 are preferably interfitted and their radially extending portions support the wire or wires of the heating element 16 which, as mentioned above, can constitute an electric resistance heater. The radially extending portions of the panels which constitute or form part of the carrier 17 can be provided with notches or with otherwise configurated recesses for portions of the wire or wires which form part of or constitute the electric heating element 16. Such heating elements are well known and are extensively used in electric hair dryers.

As already mentioned above, the maximum output of the adjustable electric heating means including the electric heater 16 and the selecting means 41 is or can be in the range of 1500 watts. However, the output of the heating means should be at 1500 watts only when the nozzle 14 is detached from the outlet 36 of the housing section 11. Since the cross-sectional area of the outlet 36 is relatively large, the temperature of air which issues from the housing section 11 does not reach or exceed the aforementioned range of 120°–130° C. if the nozzle 14 is not attached to the housing. If the nozzle 14 having an outlet 63 which is only a small or a minute fraction of the cross-sectional area of the outlet were attached to the housing section 11 while the switch 26 were set to ensure the operation of heating means with an output of 1500 watts, the temperature of hot air issuing from the outlet 63 of the nozzle 14 could well reach and even exceed the 120°–130° C. range so that the user of the hair dryer would be in danger of singing or burning his or her own hair or the user of the hair dryer would be likely to singe or burn a customer's hair.

In accordance with a feature of the invention, the aforementioned rear portion 37 of the nozzle 14 constitutes a means for maintaining an elongated reciprocable adjusting member 38 in a predetermined (second) position when the nozzle is properly attached to the housing section 11, and the adjusting member 38 then ensures that the selecting means 41 is incapable of operating the heating element 16 with a maximum output such as could cause damage to hair or injury to a person. In the illustrated hair dryer 10, the adjusting member 38 is designed to prevent selection of one (maximum) output within a range of several different outputs, i.e., to put out of commission one of the actuating elements 28 forming part of the switch 26. However, it is equally within the purview of the invention to employ adjusting means which is designed to deactivate more than a single stage of the switch 26, depending upon the ratio of cross-sectional areas of the outlets 36, 63 and upon the output of the heating element 16 at various settings of the switch 26. All that counts is to ensure that, once the nozzle 14 is attached to the housing section 11, the output of the heating element 16 cannot reach a value at which the temperature of hot air issuing from the nozzle 14 would reach a preselected maximum permissible value.

The adjusting member 38 is a mechanical adjusting member which is reciprocably mounted in internal guide means 43 (FIGS. 1–2) or 44 (FIG. 3) of the housing. This adjusting member is an elongated rod having a median or first portion 42 which is reciprocably confined in the guide means 43 or 44 of the housing section 11. The guide means 43 of FIG. 2 has a groove which is bounded by a substantially U-shaped surface permitting the median portion 42 of the adjusting member 38 to move radially of the section 11 toward and away from the adjacent portion of the heating element 16. Therefore, such hair dryer must be provided with suitable means (e.g., in the form of hooks or the like, not shown) for preventing accidental expulsion or escape of median portion 42 from the groove of the guide means 43.

The guide means 44 of FIG. 3 has a dovetailed or an analogous undercut groove for a complementary median portion of the adjusting member 38. This prevents accidental expulsion or escape of the median portion in a direction toward the center of the housing section 11. An advantage of the guide means 43 is that it is simpler to make and permits convenient insertion of the median portion 42 (by pushing the median portion through the open side of the groove and toward the adjacent portion of the front section 11). The guide means 44 of FIG. 3 is more reliable because it holds the median portion of the adjusting member against any other but reciprocatory movements in the housing section 11. However, the adjusting member which is used in the embodiment of FIG. 3 must be, or normally is, assembled of two or more parts one of which constitutes or includes the dovetailed median portion of FIG. 3. Such one part must be inserted in the longitudinal direction of the dovetailed groove.

The adjusting member 38 which is used in the hair dryer 10 of FIGS. 1, 2, 4 and 5 is made of a single piece of insulating plastic material of the type customarily employed in electrically operated appliances including conventional hair dryers which are distributed by the assignee of the present application. The front end of the adjusting member 38 is preferably enlarged to ensure that it is invariably engaged and depressed by the rear portion 37 of the nozzle 14 not later than when the nozzle is properly attached to the front end of the housing section 11. FIG. 1 shows the adjusting member 38 in its operative (second) position because the nozzle 14 is affixed to the section 11; therefore, the switch 26 of the selecting means 41 is incapable of selecting the maximum-output operation of the heating element 16. In other words, the temperature of hot air issuing from the outlet 63 of the nozzle 14 cannot exceed the aforediscussed predetermined value irrespective of which of the actuating elements 28 is depressed or otherwise moved for the purpose of selecting the corresponding output of the heating element 16. The surfaces bounding the groove of the guide means 43 confine the relatively long median portion 42 of the adjusting member 38 to reciprocatory movements in substantial parallelism with the axis of the housing section 11.

The rear or second portion 45 of the adjusting member 38 is inclined (e.g., at an angle of approximately 90°) to the longitudinal direction of the median portion 42 and includes a platform 52 (see particularly FIG. 5) which constitutes a means for preventing selection of at least one (maximum) output of the heating element 16 as long as the nozzle 14 remains attached to the section 11. That part (39) of the second portion 45 which is immediately adjacent the platform 52 extends through an opening 55 of the circuit board 49 and into the internal space 54 of a switch casing 48 having an end wall 51 which is spaced apart from and confronts the platform 52. The casing 48 resembles a cup and its bottom wall 51 carries a stud 53 which is in line with but is spaced apart from a similar stud 53 on the platform 52. A resilient element 46 in the form of a coil spring is confined in the casing 48 and has end convolutions which surround the studs 53 on the bottom wall 51 and platform 52. The studs 53 prevent buckling of the coil spring 46 and ensure that the latter can predictably bias the platform 52 toward the circuit board 49. The purpose of the coil spring 46 (which is installed in prestressed condition) is to ensure that the adjusting member 38 assumes at least one first position as soon as the nozzle 14 is detached from the housing section 11, i.e., when the rear end 37 of the nozzle is no longer in the way of the front end of the adjusting member.

Figure 5:
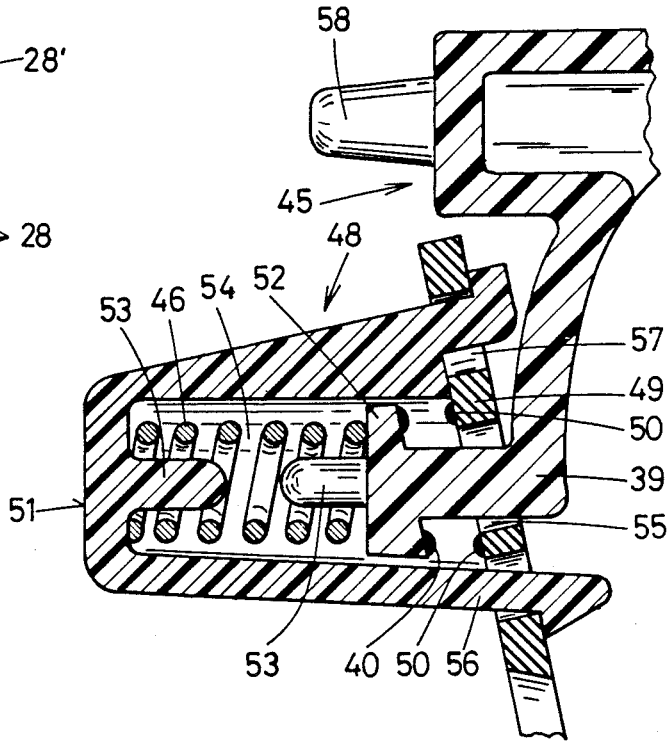
FIG. 5 is an enlarged view of a detail within the phantom-line circle V in FIG. 1.

The contact 40 is located at that side of the platform 52 which faces away from the coil spring 46, and the contact 50 is provided on the circuit board 49. FIG. 5 shows the contacts 40, 50 at a first distance from each other, namely at a distance which is maintained by the nozzle 14 as long as the latter remains connected with the section 11. When the nozzle 14 is detached and the spring 46 is free to dissipate energy, the platform 52 is moved toward the circuit board 49 and the distance between the contacts 40, 50 is reduced to zero. At such time, the switch 26 is free to select the maximum output of the electric heating element 16. It goes without saying that the platform 52 can carry two or more discrete electric contacts 40 and that the circuit board 49 can carry two or more contacts 50, for example, if the improved hair dryer 10 is designed in such a way that the switch 26 is incapable of selecting the maximum output and at least one additional high output of the heating element 16 when the nozzle 14 is attached to the housing section 11.

The casing 48 is made of an insulating material and has one, two or more preferably elastic male detent elements 56 in the form of claws which extend through apertures 57 in the circuit board 49 and ensure that the casing 48 is held in the illustrated position in which the contact or contacts 40 engage the contact or contacts 50 when the spring 46 is free to dissipate energy in response to detachment of the nozzle 14 from the housing section 11. The casing 48 can be provided with two elastic detent elements 57 which are located diametrically opposite each other. This casing is sufficiently deformable to permit the detent elements 56 to move nearer to each other preparatory to their insertion into the respective apertures 57 to thereupon move away from each other in order to separably couple the casing to the circuit board 49.

The distance between the studs 53 can but need not be reduced to zero when the adjusting member 38 assumes the (second) position of FIG. 5. In either event, the mutual spacing of the studs 53 must be selected in such a way that the platform 52 has freedom of movement between its end positions and that the casing 48 can be attached to or detached from the circuit board 49.

The housing section 11 carries a stop 62 which is located in the region of the outlet 36 and serves as a means for limiting the extent of movability of the adjusting member 38 in response to bias of the spring 46 upon detachment of the nozzle 14. The circuit board 49 assists the stop 62 in limiting the extent of movability of the adjusting member 38 in response to detachment of the nozzle 14, i.e., the platform 52 (and hence the entire adjusting member 38) is arrested when the movable contact or contacts 40 engage the fixed contact or contacts 50 on the circuit board 49. The stop 62 can form an integral part of the housing section 11, i.e., it can be formed in the cavity of a mold at the time the section 11 is made from a suitable insulating material.

If the adjusting member 38 is relatively long and rather heavy, if the frictional engagement between the median portion 42 of such adjusting member and the guide means 43 or 44 is rather pronounced, and if impurities in the housing oppose the movements of the member 38, it is advisable to provide the hair dryer 10 with stronger means for biasing the adjusting member to the at least one first position, e.g., by employing two resilient elements. One of the resilient elements in the hair dryer of FIGS. 1, 2, 4 and 5 is the aforediscussed coil spring 46. Another resilient element is a second coil spring 59 which indirectly reacts against the housing and bears against a third portion of the adjusting member 38 between the median portion 42 and the second portion 45. The third portion has a stud 58 (see particularly FIG. 5) which confronts a similar stud 61 at the inner side 60 of rear part of the handle 23. At least one first end convolution of the second coil spring 59 surrounds the stud 58, and at least one second end convolution of the spring 59 surrounds the stud 61 in the handle 23. The stud 61 is or can be an integral part of the handle 23. The coil spring 59 is or can be much stronger than the coil spring 48 and can be installed in such condition that it invariably stores a substantial amount of energy. The stud 58 is provided on the adjusting member 38 in the region of the junction between straight median portion 42 and the inclined second portion 45. The two coil springs (46 and 59) invariably ensure that the adjusting member 38 assumes its inoperative position as soon as the nozzle 14 is detached from the housing section 11 irrespective of the extent of friction between the median portion 42 and the guide means 43 or 44 and irrespective of the extent of contamination of the guide means 43 or 44 after long periods of use of the hair dryer.

The improved hair dryer is susceptible of many additional modifications. For example, the dimensions and/or the configuration of the adjusting member can be altered in a number of different ways, the same as the dimensions and shape of guide means for the adjusting member. All that counts is to ensure that the range of different outputs of adjustable heating means in the housing is changed in response to attachment of the nozzle 14 to the housing section 11 so that the temperature of hot air issuing from the outlet 63 cannot exceed a preselected value. The exact configuration and dimensions of the adjusting member 38 or of an analogous adjusting member will depend upon the availability of space in the interior of the housing and also upon the design and locus of the selecting means 41. Furthermore, the exact configuration and/or dimension of the adjusting member 38 or an analogous adjusting member will also depend on the selected position of the circuit board 49 with reference to the handle 23 and with reference to the circuit board 66. If the configuration of the space which is available for the adjusting member is rather complex, the adjusting member can be assembled from two or more discrete parts to facilitate its insertion into and its assembly in the housing. A rather complex adjusting member can be assembled of two or more pieces or parts even if such pieces or parts can be put together prior to insertion of the assembled adjusting member into the housing.

It is also possible to select an adjusting member which is pivotable, rotatable and/or similarly movable between its first and second positions. If the nozzle 14 can be threadedly connected to the housing section 11, rotation of the nozzle with respect to the section 11 can result in movement of the adjusting member between its operative and inoperative positions. Furthermore, axial movement of the nozzle 14 to or from its attached or operative position can entail angular or pivotal movements of the adjusting member with reference to the housing and the output selecting means. If the adjusting member is rotatable or pivotable, its angular or pivotal movement will result in opening or closing of one or more switches to thus ensure that at least one (namely the maximum) output of the heating element 16 cannot be selected when the nozzle is properly affixed to the housing.

It is further possible to change the dimensions and/or configuration of the nozzle 14 and/or of its outlet 63. It is presently preferred to employ elastic or other detent elements as a means for separably attaching the nozzle 14 to the housing section 11. However, and as already mentioned above, it is equally possible to provide the nozzle with internal or external threads which can be moved into or out of mesh with complementary external or internal threads in the region of the outlet 36 of the housing section 11.

Still further, it is possible to embody the improved adjusting means or analogous adjusting means in other types of hair dryers, e.g., in hair dryers having differently designed heating elements, impellers, diffusers, motors, handles, housings and/or output selecting means.

It is also possible to operate without a mobile adjusting member. For example, the housing can confine or carry a proximity detector which is caused to generate a signal in response to attachment of the nozzle 14 to the housing section 11, and such signal is used to deactivate one or more stages of the output selecting means. Magnetic or other adjusting means can be used with equal or similar advantage. The illustrated simple mechanical adjusting member 38 or an analogous mechanical adjusting member is preferred at this time because it can accomplish the adjustment of the heating means without the need for complex electrical nd/or electronic components.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A hair dryer comprising a housing having an air admitting inlet and an air discharging outlet remote from said inlet, said housing defining a path for the flow of air from said inlet to said outlet; means for inducing the flow of air from said inlet to said outlet; adjustable means for heating the air in said path; a flow-directing nozzle separably connected to said outlet; and means for adjusting said heating means in automatic response to connection of said nozzle to said outlet.

2. The hair dryer of claim 1, wherein said heating means includes a heating element having a predetermined range of different outputs and means for selecting a desired output of said heating element within said range, said adjusting means including means for preventing selection of at least one of said different outputs within said range.

3. The hair dryer of claim 2, wherein said range of outputs includes a maximum output and at least one additional output, said adjusting means including means for preventing selection of said maximum output.

4. The hair dryer of claim 1, wherein said outlet has a first cross-sectional area and said nozzle has a second outlet with a second cross-sectional area which is a relatively small fraction of said first cross-sectional area.

5. The hair dryer of claim 4, wherein said first cross-sectional area is a multiple of said second cross-sectional area.

6. A hair dryer comprising a housing having an air admitting inlet and an air discharging outlet remote from said inlet, said housing defining a path for the flow of air from said inlet to said outlet; means for inducing the flow of air from said inlet to said outlet; adjustable means for heating the air in said path; a flow-directing nozzle separably connected to said outlet; and means for adjusting said heating means in response to connection of said nozzle to said outlet, said adjusting means including at least one adjusting member which is movably carried by said housing and is movable between at least one first position and a second position, said nozzle having means for maintaining said adjusting member in said second position as long as said nozzle remains connected to said outlet.

7. The hair dryer of claim 6, wherein said adjusting member is reciprocable with reference to said housing between said first and second positions.

8. The hair dryer of claim 7, wherein said housing has internal guide means for said adjusting member.

9. The hair dryer of claim 8, wherein said guide means includes a groove and said adjusting member includes a median portion which is reciprocably received in said groove.

10. The hair dryer of claim 9, wherein said adjusting member further comprises a second portion which is inclined with reference to said median portion, said selecting means including a first contact in said housing and a second contact on said second portion, said adjusting means further comprising means for biasing said adjusting member to said at least one first position in which said second contact is disposed at a first distance from said first contact, said second contact being disposed at a different second distance from said first contact in response to movement of said adjusting member to said second position.

11. The hair dryer of claim 10, wherein said selecting means includes a casing for said second portion, said contacts and said biasing means.

12. The hair dryer of claim 11, wherein said selecting means further comprises a circuit board, said first contact being provided on said board and said casing being mounted on said board.

13. The hair dryer of claim 12, wherein said housing includes a hollow handle, said circuit board and said casing being disposed in said handle.

14. The hair dryer of claim 11, wherein said casing includes a wall which is remote from said second portion of said adjusting member, said wall and said second portion having spaced-apart confronting studs and said biasing means including a coil spring having end convolutions surrounding said studs.

15. The hair dryer of claim 11, wherein said selecting means further comprises a circuit board having an opening, said first contact being provided on said board and said casing being mounted on said board, said second portion of said adjusting member extending into said casing by way of said opening.

16. The hair dryer of claim 11, wherein said selecting means further comprises a circuit board having apertures and said casing includes male detent elements extending through said apertures to couple said casing to said board.

17. The hair dryer of claim 16, wherein said detent elements include resilient claws.

18. The hair dryer of claim 6, wherein said adjusting means further comprises a plurality of resilient elements reacting against said housing and arranged to bias said adjusting member to said at least one first position.

19. The hair dryer of claim 18, wherein said adjusting member includes a first portion which is reciprocably guided in said housing, a second portion which is inclined relative to said first portion an is acted upon by one of said resilient elements, and a third portion disposed between said first and second portions and acted upon by the other of said resilient elements.

20. The hair dryer of claim 19, wherein said third portion includes a stud and said other resilient element includes a coil spring having at least one convolution surrounding said stud.

21. The hair dryer of claim 6, wherein said housing includes means for limiting the extent of movability of said adjusting member with reference to said housing.

22. The hair dryer of claim 21, wherein said housing includes a rear section and a front section, said inlet being provided in said rear section and said outlet and said limiting means being provided in said front section.

23. The hair dryer of claim 6, wherein said adjusting means further comprises means for biasing said adjusting member to said at least one first position, said maintaining means including means for moving said adjusting member from said at least one first position to said second position in response to connection of said nozzle to said outlet.

24. The hair dryer of claim 6, wherein said selecting means includes a first and a second electric contact, said adjusting member including means for moving one of said contacts with reference to the other of said contacts in response to connection of said nozzle to said outlet.

* * * * *